US005121956A

United States Patent [19]

Horkey

[11] Patent Number: 5,121,956

[45] Date of Patent: Jun. 16, 1992

[54] TONG STRUCTURE

[75] Inventor: Edward J. Horkey, Phoenix, Ariz.

[73] Assignee: Horkey & Associates, Inc., Tempe, Ariz.

[21] Appl. No.: 733,447

[22] Filed: Jul. 22, 1991

[51] Int. Cl.[5] ..... B25J 1/06

[52] U.S. Cl. ..... 294/99.2; 294/11

[58] Field of Search ..... 294/99.2, 8.5, 11, 33, 294/50.8, 50.9

[56] References Cited

U.S. PATENT DOCUMENTS

| | | | |
|---|---|---|---|
| D. 265,375 | 7/1982 | Alvarez . | |
| 19,436 | 2/1858 | Moore . | |
| 22,086 | 11/1858 | Meschutt . | |
| 50,584 | 10/1865 | Holly . | |
| 87,876 | 3/1869 | Russell . | |
| 88,820 | 4/1869 | Stith . | |
| 92,530 | 7/1869 | Heptinstall . | |
| 103,920 | 6/1870 | Percival . | |
| 496,158 | 4/1893 | Henkle | 294/99.2 |
| 1,181,927 | 5/1916 | Roth | 294/11 |
| 1,497,542 | 6/1923 | Carlson . | |
| 1,527,288 | 2/1922 | Smith . | |
| 1,630,013 | 3/1926 | Hyatt . | |
| 1,704,548 | 11/1926 | Alberg . | |
| 1,717,396 | 8/1928 | Minzoff . | |
| 1,882,934 | 8/1930 | Rogaczewicz . | |
| 1,976,977 | 6/1933 | Zinky . | |
| 2,096,104 | 7/1936 | Green . | |
| 2,185,561 | 4/1939 | Nenstiel . | |
| 2,326,676 | 4/1942 | Peters . | |
| 2,541,819 | 2/1951 | Hudson | 294/99.2 X |
| 3,042,438 | 5/1959 | Turner . | |
| 3,118,697 | 5/1962 | Watters . | |
| 3,124,383 | 4/1962 | Cahan . | |
| 3,369,834 | 2/1968 | Miles | 294/50.9 |
| 3,384,407 | 3/1966 | Thrash . | |
| 3,574,380 | 4/1971 | Tague . | |
| 4,105,238 | 8/1978 | Stright . | |
| 4,176,871 | 4/1979 | Stover . | |
| 4,186,956 | 2/1980 | Flynn . | |
| 4,225,170 | 9/1980 | Flynn . | |
| 4,240,657 | 12/1980 | Feighery . | |
| 4,252,357 | 2/1981 | Majors . | |
| 4,307,909 | 12/1981 | Yaworski . | |
| 4,355,831 | 10/1982 | Smith . | |
| 4,474,396 | 10/1984 | Dennie . | |
| 4,477,113 | 10/1984 | Lybolt . | |
| 4,478,449 | 10/1984 | Bernier . | |

FOREIGN PATENT DOCUMENTS

| | | | |
|---|---|---|---|
| 58053 | 6/1937 | Norway | 294/11 |
| 5701 | of 1884 | United Kingdom | 294/99.2 |
| 223737 | 10/1924 | United Kingdom | 294/50.9 |

*Primary Examiner*—Robert R. Song
*Assistant Examiner*—Joseph D. Pape
*Attorney, Agent, or Firm*—William W. Haefliger

[57] ABSTRACT

A tong apparatus having first and second hand grippable members, a first work gripping element associated with the first hand grippable member, and a second work gripping element associated with the second hand grippable member, the improvement comprising structure for amplifying movement of the first work gripping element relative to movement of the second work gripping element and also relative to the first hand grippable member, in response to relative movement of the first and second hand grippable members. Amplification of motion of the work gripping elements is provided, aiding in pick-up of both large and small work pieces. The surfaces for the operator to grasp are long enough that two hands may conveniently be used, if required, for heavy loads.

8 Claims, 1 Drawing Sheet

15
10
3
3
11
12
α
33
22
34
21
16
31
23
19a
19'
30
20
19b
19
17
18
17
36
2
35
36
β
β'
2
13a
13
14

TONG STRUCTURE

BACKGROUND OF THE INVENTION

This invention relates generally to tongs, and more particularly an improved tongs characterized by amplification of relative motion of work gripping elements, whereby the user need move hand grippable members only a relatively small amount in order to effect tong grasping of large work, such as a log for a fireplace. Ease of use is thereby facilitated.

There is need for tongs of the type referred to above. Prior tongs typically would open or close together only by angular amounts equal to relative angular displacements of hand gripped members, whereby an undesirably great angle was required to open the work gripping ends of the tongs for grasping larger logs or work pieces. Both hands of the user were typically required to open the tongs arms to grasp such wood pieces, since the metal loop spring connecting the tongs arms had to be "opened" (or closed) to a relatively large degree. Inconvenient hand grip lengths were also associated with such prior tongs.

SUMMARY OF THE INVENTION

It is a major object of the invention to provide an improved tongs, meeting the above needs. Basically, the apparatus of the invention comprises first and second hand grippable members, a first work gripping element associated with the first hand grippable member, and a second work gripping element associated with the second hand grippable member, together with means for amplifying movement of the first work gripping element relative to movement of the second work gripping element and also relative to the first hand grippable member, in response to relative movement of said first and second hand grippable members. A looping connector spring typically connects the hand grippable members.

As will be seen, such means typically includes first and second arms respectively integral with the hand grippable members, and a first auxiliary arm integral with the first work gripping element, and having operative pivotal connection to the first and second arms. The first auxiliary arm advantageously comprises a lever having operative fulcrum connection with said first arm. The amplifying means referred to may also include a link having a primary pivotal connection with the lever in spaced relation to said fulcrum connection, and secondary pivotal connection with the second arm.

Another object is to provide first spacing between the fulcrum connection and the primary connection, and second spacing between the primary and secondary pivotal connections, said first spacing exceeding said second spacing. In this way, the motions of the lever and link provide amplification of relative motion of the work gripping elements of the tongs, enabling easy pick-up of both large and small work pieces.

Yet another object is to provide the first and second arms in the form of elongated narrow metallic strips having flat surfaces at locations adjacent the primary and secondary pivotal connections respectively, those connections defining parallel axes normal to said flat surfaces.

As will be seen, the first hand grippable member may typically comprise a twisted extension of the first arm, and the second hand grippable member may comprise a twisted extension of said second arm. A high strength tongs may thereby be formed from narrow metal (steel) strips.

These and other objects and advantages of the invention, as well as the details of an illustrative embodiment, will be more fully understood from the following specification and drawings, in which:

DRAWING DESCRIPTION

FIG. 1 is a side view of a tongs embodying the invention; and

FIGS. 2 and 3 are views taken on lines 2—2, and 3—3, respectively, in FIG. 1.

DETAILED DESCRIPTION

Figures 1, 2, 3:
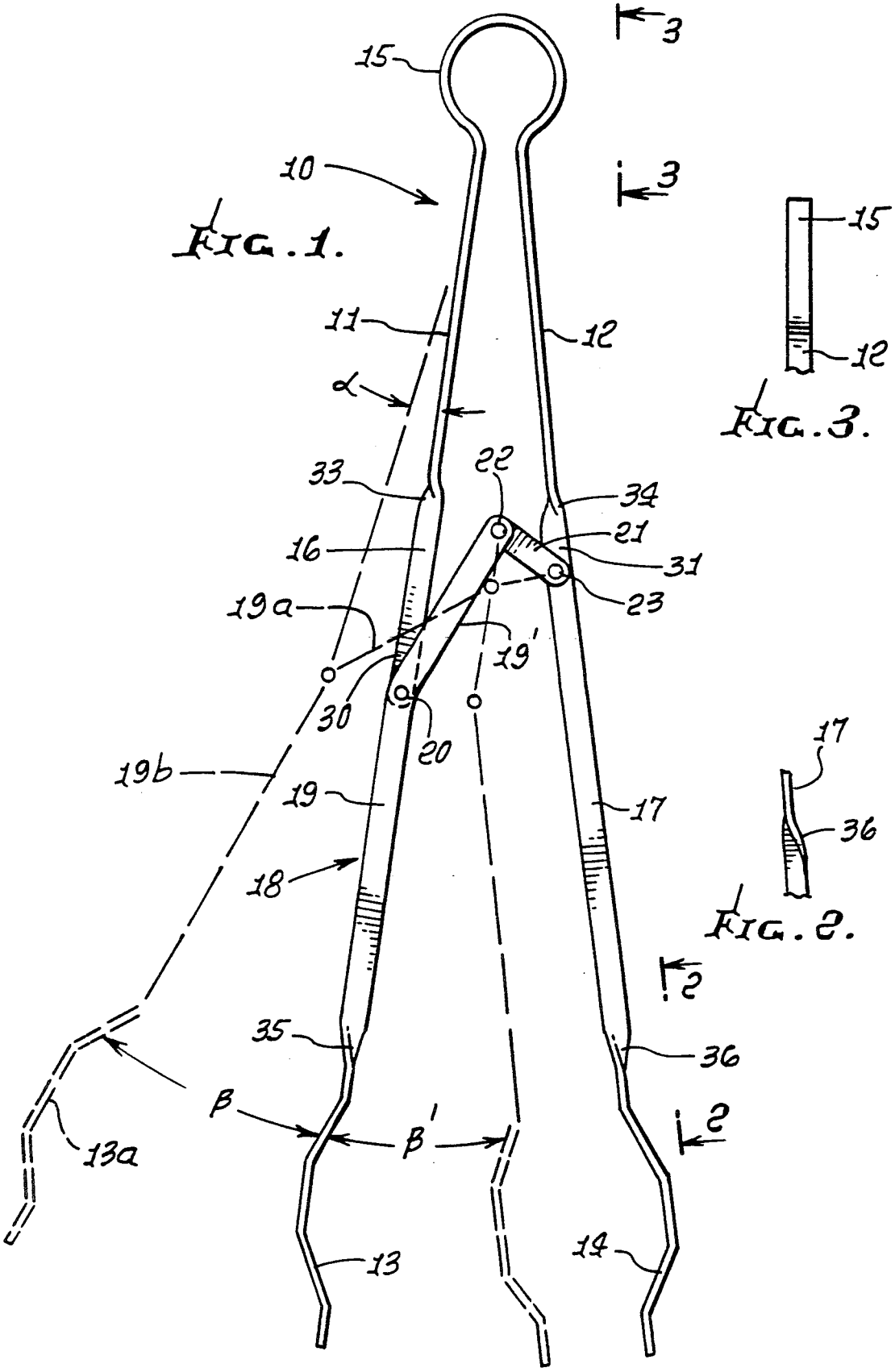

In FIG. 1, the tongs 10 includes first and second hand grippable members, as at 11 and 12. A first work gripping element 13 is associated with member 11, and a second work gripping element 14 is associated with member 12.

Means is provided for amplifying movement of the first work gripping element relative to movement of the second work gripping element and also relative to the first hand grippable member, in response to relative movement of said first and second hand grippable members. Thus, as the first hand grippable member 11 is swung (opened further) by an angle $\alpha$, the first work gripping member 13 is swung relative to 11 and by an angle $\beta$, wherein $\beta > \alpha$, i.e. motion is amplified. Similarly, as 11 is swung (closed further) by an angle $\alpha'$, member 13 is swung relative to 11, and to 14, by an angle $\beta'$, i.e. again, motion is amplified. This provides ease of gripping large or small work pieces, since hand grippable member 11 need be swung relative to 12 by only a small amount, as against force (tension) exerted by the spring loop 15 connecting upper ends of 11 and 12, as shown. All elements and members shown are typically metallic.

Means for effecting such amplification will now be described. It includes first and second arms 16 and 17 respectively integral with the members 11 and 12, together with a first auxiliary arm 18 integral with element 13. The first auxiliary arm 18 is shown in the form of a lever 19 having operative fulcrum connection at 20 with the first arm 16. Such means also typically includes a link 21 having primary pivotal connection at 22 with the lever (as with lever extent 19' between 16 and 17) in spaced relation to connection 20, and secondary pivotal connection at 23 with the second arm 17. Such pivotal connection may employ pivot pins, at locations 20, 22 and 23. The spacing between 20 and 22 is greater than the spacing between 22 and 23, the ratio of such spacings being between about 3/2 and 5/2. Lever 19 has the broken line position **19*a* when element 13 is swung to position 13*a*; and lever 19 has the broken line position 19*b* when 13 is swung to position 13*b***.

It will be noted that second arm 17 extends between member 12 and element 14, and is integral with both of these. Thus, second arm 17 is substantially longer than first arm 16, which may terminate near connection 20, as shown. The lever arm extent 19" between 13 and 20 is such that the sum of the lengths of 13, 19, 16 and 11 is about the same as the sum of the lengths of 14, 17 and 12.

It will further be noted that the first and second arms comprise elongated, narrow metallic strips having flat surfaces at locations adjacent said primary and secondary pivotal connections respectively, said connections defining parallel axes normal to said flat surfaces.

Such flat surfaces appear at 30 and 31, the pivot axes at 20 and 23 being parallel and normal to 30 and 31. Also, member 11 is a twisted extension of arm 16; and member 12 is a twisted extension of arm 17. The twists are seen at 33 and 34 to be one-quarter turns. Similar twists are seen at 35 and 36. Such twisting strengthens the tongs, and enables use of narrower metal tong strips.

I claim:

1. In tong apparatus having first and second hand grippable members, a first work gripping element associated with the first hand grippable member, and a second work gripping element associated with the second hand grippable member, the improvement comprising:

a) means for amplifying movement of the first work gripping element relative to movement of the second work gripping element and also relative to the first hand grippable member, in response to relative movement of said first and second hand grippable members, b) said means including first and second arms respectively integral with said hand grippable members, and a first auxiliary arm integral with the first work gripping element, and having operative pivotal connection to said first arm, and indirect pivotal connection to said second arm, said first auxiliary arm comprising a lever having operative fulcrum connection with said first arm, c) said means including a link having a primary pivotal connection with said lever in spaced relation to said fulcrum connection, and secondary pivotal connection with said second arm, d) there being first spacing between said fulcrum connection and said primary pivotal connection, and second spacing between said primary and secondary pivotal connections, said first spacing exceeding said second spacing.

2. The combination of claim 1 wherein said second arm extends between said second hand grippable member and said second work gripping element.

3. The combination of claim 2 wherein said second arm is integral with said second hand grippable member and said second work gripping element.

4. The combination of claim 3 wherein said second arm is substantially longer than said first arm.

5. In tong apparatus having first and second hand grippable members, a first work gripping element associated with the first hand grippable member, and a second work gripping element associated with the second hand grippable member, the improvement comprising:

a) means for amplifying movement of the first work gripping element relative to movement of the second work gripping element and also relative to the first hand grippable member, in response to relative movement of said first and second hand grippable members, b) said means including first and second arms respectively integral with said hand grippable members, and a first auxiliary arm integral with the first work gripping element, and having operative pivotal connection to said first and second arms, c) said second arm extending between said second hand grippable member and said second work gripping element, d) said second arm being integral with said second hand grippable member and said second work gripping element, said second arm being substantially longer than said first arm, e) and including a looping connector spring connecting said hand grippable members.

6. The combination of claim 1 wherein said first and second arms comprise elongated, narrow metallic strips having flat surfaces at locations adjacent said primary and secondary pivotal connections respectively, said connections defining parallel axes normal to said flat surfaces.

7. The combination of claim 1 wherein said first hand grippable member comprises a twisted extension of said first arm, and said second hand grippable member comprises a twisted extension of said second arm.

8. An improved tongs, comprising a) first and second tong arms, the second longer that the first, b) a spring loop connecting said arms at first ends thereof, c) and a lever having fulcrum connection with a second end of the first arm, and a link having pivotal connection with the lever and with the second arm, d) there being work gripping elements on the lever and on the second arm, e) whereby amplification of motion of said work gripping elements is provided, facilitating pickup of both large and small work pieces.

* * * * *